US012667149B2

(12) United States Patent
Ma

(10) Patent No.: US 12,667,149 B2
(45) Date of Patent: Jun. 30, 2026

(54) BREATHABLE STRUCTURE, BREATHABLE FABRIC AND GARMENTS

(71) Applicant: Longsheng Ma, Suzhou (CN)

(72) Inventor: Longsheng Ma, Suzhou (CN)

( * ) Notice: Subject to any disclaimer, the term of this patent is extended or adjusted under 35 U.S.C. 154(b) by 0 days.

(21) Appl. No.: 19/021,356

(22) Filed: Jan. 15, 2025

(65) Prior Publication Data

US 2025/0151825 A1 May 15, 2025

Related U.S. Application Data

(63) Continuation of application No. PCT/CN2023/103104, filed on Jun. 28, 2023.

(30) Foreign Application Priority Data

Jul. 21, 2022 (CN) ..... 202221891348.0

(51) Int. Cl.

| | |
|---|---|
| ***A41D 31/14*** | (2019.01) |
| ***A41D 19/00*** | (2006.01) |
| ***A41D 19/01*** | (2006.01) |
| ***A41D 27/28*** | (2006.01) |

(52) U.S. Cl.

CPC ..... *A41D 31/145* (2019.02); *A41D 19/0055* (2013.01); *A41D 19/01* (2013.01); *A41D 27/285* (2013.01); *A41D 19/0048* (2013.01)

(58) Field of Classification Search

CPC ..... A41D 27/28; A41D 3/04; A41D 13/0158

See application file for complete search history.

(56) References Cited

U.S. PATENT DOCUMENTS 3,703,432 A * 11/1972 Koski ..... A41D 3/04 264/156
4,185,327 A * 1/1980 Markve ..... A41D 13/0156 2/466
11,606,993 B2 * 3/2023 Mattioni ..... A41D 27/28

FOREIGN PATENT DOCUMENTS

CN 202774326 U * 3/2013
CN 105380309 A 3/2016
CN 216875088 U * 7/2022
CN 219679825 U * 9/2023

(Continued)

OTHER PUBLICATIONS

CN 219679825 abstract (Year: 2023).*
CN 216875088 english abstract (Year: 2022).*
CN 202774326 english astract (Year: 2013).*

*Primary Examiner* — Katherine M Moran
(74) *Attorney, Agent, or Firm* — Nitin Kaushik

(57) ABSTRACT

The present disclosure provides a breathable structure, a breathable fabric and garments, wherein the breathable structure comprises a first protection module and a second protection module configured to fit with the same along a length direction; any one of the protection modules comprises at least one protection unit, and when there are a plurality of protection units, each of the protection units is arranged along a width direction; any one of the protection units is of an arched sheet structure, and the arching height of the sheet structure decreases along the length direction; one end of the second protection unit extends below the first protection unit along the length direction so as to establish a fit between the first protection module and the second protection module; a breathable channel is formed through between the first protection unit and the second protection unit.

11 Claims, 4 Drawing Sheets

(56) References Cited

FOREIGN PATENT DOCUMENTS

| | | | |
|---|---|---|---|
| JP | H07157908 | A | 6/1995 |
| TW | M557986 | U | 4/2018 |

* cited by examiner

BREATHABLE STRUCTURE, BREATHABLE FABRIC AND GARMENTS

CROSS-REFERENCE TO RELATED APPLICATIONS

The application claims priority to Chinese patent application No. 202221891348.0, filed on Jul. 21, 2022, the entire contents of which are incorporated herein by reference.

TECHNICAL FIELD

The present disclosure relates to the technical field of breathability of garments, in particular to a breathable structure, a breathable fabric and garments.

BACKGROUND

Garments such as raincoats or protective suits are now required to meet certain standards of protection. That is to say, a raincoat shall have good waterproof performance, while a protective suit shall be fireproof, liquid-proof, etc. In order to meet the above requirements, garments such as raincoats or protective suits are usually better sealed and less breathable. Especially when working in hot weather or a high temperature environment, it is sultry to wear the above garments, resulting in extremely poor physical comfort.

In order to solve the above problems, currently some garments such as raincoats or protective suits are provided with air holes and a shield is arranged to cover the air holes. However, when garments of the above breathable manner are worn, they will be closely attached to the skin, thus affecting the breathable effect. As a result, the shield affects the protective performance of garments due to untight covering. Therefore, it is necessary to propose further solutions for the above problems.

SUMMARY

The present disclosure aims to provide a breathable structure, a breathable fabric and garments to overcome the shortcomings of the prior art.

In order to solve the above technical problems, the present disclosure claims a technical solution as follows:

a breathable structure, comprising a first protection module and a second protection module configured to fit with the same along a length direction;

wherein the first protection module comprises at least one first protection unit, and when there are a plurality of the first protection units, each of the first protection units is arranged along a width direction;

any one of the first protection units is of an arched sheet structure, and an arching height of the sheet structure decreases along the length direction;

the second protection module comprises a number of second protection units equal to that of the first protection units, and when there are a plurality of the second protection units, each of the second protection units is arranged along a width direction;

any one of the second protection units is of an arched sheet structure, and an arching height of the sheet structure decreases along the length direction; and one end of the second protection unit extends below the first protection unit along the length direction so as to establish a fit between the first protection module and the second protection module, and a breathable channel is formed through between the first protection unit and the second protection unit.

As an improvement of the breathable structure according to the present disclosure, when there are a plurality of protection units in the first protection module and the second protection module, the protection units are closely arranged along the width direction.

As an improvement of the breathable structure according to the present disclosure, the first protection unit and the second protection unit may be of a sheet structure with an arched shape such as a pointed top, a dome or a square top.

As an improvement of the breathable structure according to the present disclosure, the first protection unit is aligned with the second protection unit, and in this way, one end of the second protection unit extends directly below the corresponding first protection unit along the length direction.

As an improvement of the breathable structure according to the present disclosure, the first protection unit and the second protection unit are arranged in a staggered manner. In this way, one end of the second protection unit extends obliquely below the first protection unit along the length direction, and the first protection unit overlaps on an arch surface of the second protection unit.

As an improvement of the breathable structure according to the present disclosure, at least one fifth of the second protection unit extends below the first protection unit.

As an improvement of the breathable structure according to the present disclosure, when there are a plurality of protection units in the first protection module and the second protection module, the first protection module and the second protection module are integrally formed, or each of the first protection units is connected to a first substrate and each of the second protection units is connected to a second substrate.

In order to solve the above technical problems, the present disclosure claims a technical solution as follows:

a breathable fabric, comprising multiple first protection modules and multiple second protection modules;

wherein the first protection modules and the second protection modules are arranged alternately, and the adjacent first protection module and second protection module are arranged according to the arrangement in the above-mentioned breathable structure.

In order to solve the above technical problems, the present disclosure claims a technical solution as follows:

garments, entirely or partially being made of the above-mentioned breathable fabric.

As an improvement of garments according to the present disclosure, when the garment is partially made of the above-mentioned breathable fabric, the breathable fabric is detachably attached to a front and/or back and/or sleeves and/or trousers and/or a hat etc. of the garment.

As an improvement of garments according to the present disclosure, the garments are raincoats or protective suits.

Compared with the prior art, the present disclosure has the beneficial effects that a modularly arranged protection unit is adopted for the breathable structure of the present disclosure, which can be more conveniently combined and applied to corresponding garments. In the breathable structure of the present disclosure, the first protection units are configured to fit with the second protection units to form relatively narrow and long breathable channels that are closely arranged, so that the breathable structure has both good protection performance and good breathability.

BRIEF DESCRIPTION OF DRAWINGS

To illustrate technical solutions in embodiments of the present disclosure or the prior art more clearly, accompanying drawings to be used for describing the embodiments or prior art are introduced briefly in the following. Apparently, the accompanying drawings in the following description are only some embodiments of the present disclosure, and persons of ordinary skill in the art can derive other drawings from these accompanying drawings without creative efforts.

DETAILED DESCRIPTION OF THE EMBODIMENTS

The technical solutions in the embodiments of the present disclosure will be clearly and completely described below with reference to the drawings in the embodiments of the present disclosure. Obviously, the embodiments described are only a part of, not all, the embodiments of the present disclosure. Based on the embodiments described herein, all other embodiments obtained by those of ordinary skill in the art without creative work are within the scope of the present disclosure.

Embodiment 1

Figure 1:
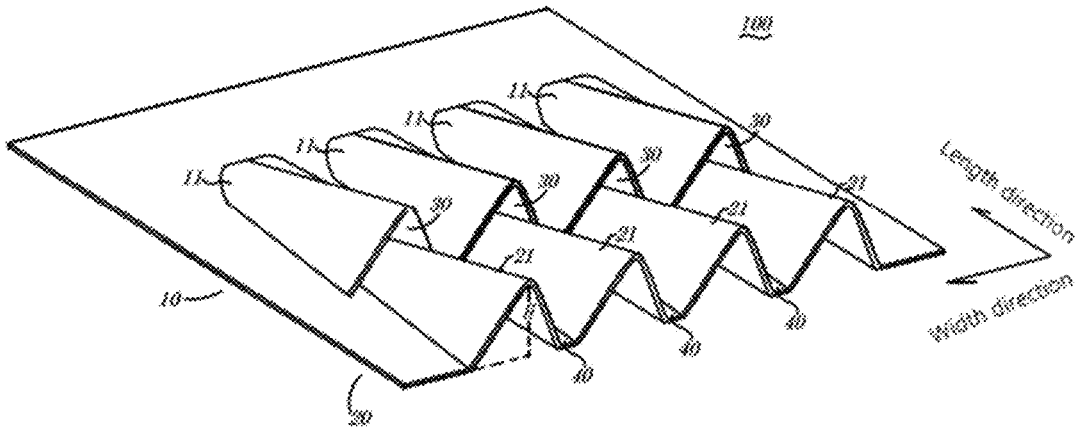
FIG. 1 is a perspective view of a breathable structure according to Embodiment 1 of the present disclosure.
Figure 2:
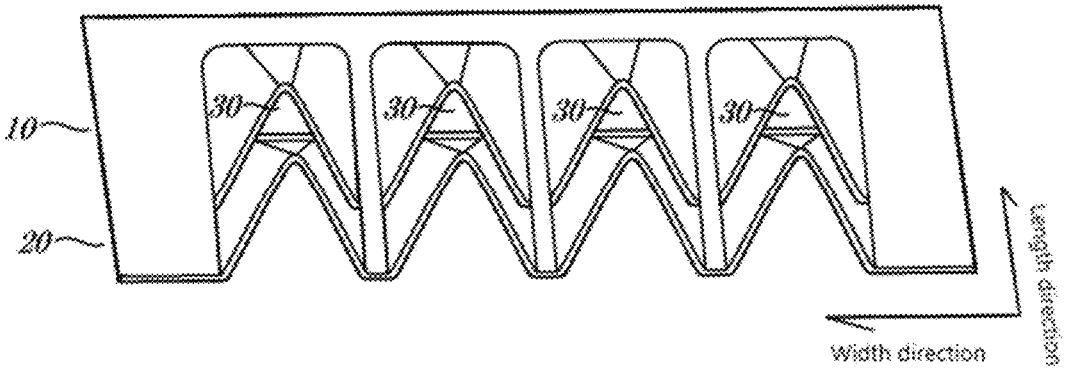
FIG. 2 is another perspective view of the breathable structure according to Embodiment 1.

As shown in FIGS. 1 and 2, this embodiment provides a breathable structure 100.

The breathable structure 100 of this embodiment includes a first protection module 10 and a second protection module 20 configured to fit with the same along a length direction.

In which, the first protection module 10 and the second protection module 20 are configured to fit with each other in such a manner that the second protection module 20 partially extends below the first protection module 10 along the length direction, so as to form a narrow and long breathable channel 30 between the first protection module 10 and the second protection module 20. In this way, the breathable structure 100 has both good protection performance and good breathability.

Specifically, the first protection module 10 includes at least one first protection unit 11. The second protection module 20 comprises a number of second protection units 21 equal to that of the first protection units 11. In order to form the above-mentioned long and narrow breathable channel 30, any one of the first protection unit 11 and the second protection unit 21 is of an arched sheet structure. Thus, there is a space under the sheet structure. In an embodiment, the first protection unit 11 and the second protection unit 21 may be of a sheet structure with an arched shape such as a pointed top, a dome or a square top. In addition, the arching height H of the sheet structure decreases along the length direction.

In this way, one end of the second protection unit 21 extends to a space below the first protection unit 11 along the length direction, so as to establish a fit between the first protection module 10 and the second protection module 20, and a narrow and long breathable channel 30 is formed through between the first protection unit 11 and the second protection unit 21. In this way, while the long and narrow breathable channel 30 plays a breathable role, due to the relatively narrow inner diameter of the channel, it is difficult for an external object to be protected against to reversely enter into the breathable channel 30, thereby leading to a better protection effect.

One end of the second protection unit 21 may extend directly or obliquely below the first protection unit 11. That is, when the first protection module 10 and the second protection module 20 are configured to fit with each other, the first protection unit 11 can be aligned with the second protection unit 21 or arranged in a staggered manner with respect to the second protection unit 21, and the first protection unit 11 overlaps on an arch surface of the second protection unit 21.

In order to obtain a corresponding length of the breathable channel 30 according to different requirements, the length of the second protection unit 21 extending to the space below the first protection unit 11 can be controlled. In an embodiment, at least one fifth of the second protection unit 21 extends below the first protection unit 11. That is, the more a portion of the second protection unit 21 extends below the first protection unit 11, the longer the length of the corresponding breathable channel 30 becomes.

As described above, since the arching height H decreases along the length direction, when the breathable structure 100 of this embodiment is applied to garments, the breathable channels 30 are arranged obliquely downwards, further making it difficult for an external object to be protected against to reversely enter into the breathable channel 30, thereby improving the protection performance of the breathable structure 100.

In addition, when the breathable structure 100 of this embodiment is applied to garments, since the first protection unit 11 and the second protection unit 21 are designed as arched sheet structures, the breathable structure 100 contacts a human body only through lower end edges of the sheet structures. In this way, due to the small contact area with the human body, the corresponding garments have good breathability, thus overcoming the drawbacks existing in the manner of forming holes on the garments to achieve breathability.

In order to further improve the breathable effect of the breathable structure 100, a plurality of first protection units 11 and second protection units 21 may be provided so that more breathable channels 30 can be formed. Specifically, when there are a plurality of first protection units 11 and second protection units 21, each of the first protection units 11 and second protection units 21 is arranged along the width direction. Preferably, when there are a plurality of protection units in the first protection module 10 and the second protection module 20, the protection units are closely arranged along the width direction. With this arrangement, the density of exhaust passages can be increased per unit area.

Meanwhile, the protection units are closely arranged along the width direction, which is further beneficial to reduce the area between the protection units, thereby reducing the contact area of the breathable structure 100 with the human body, and further making the corresponding garments have good breathability, thus overcoming the disadvantages existing in the way of forming holes on the garments to achieve breathability.

In the molding mode, when there are a plurality of protection units in the first protection module 10 and the second protection module 20, the first protection module 10 and the second protection module 20 may be integrally molded. The integral molding method may include injection molding or spinning. Alternatively, each protection unit may be molded separately and then combined on a substrate 40 by bonding or the like.

Embodiment 2

Figure 3:
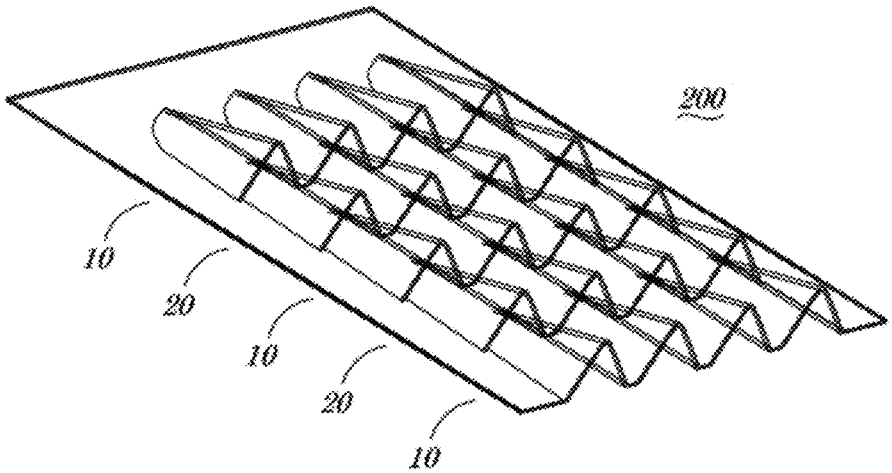
FIG. 3 is a perspective view of a breathable fabric according to Embodiment 2 of the present disclosure.

As shown in FIG. 3, this embodiment provides a breathable fabric 200 with the above-mentioned breathable structure.

The breathable fabric 200 of this embodiment comprises multiple first protection modules 10 and multiple second protection modules 20.

The first protection modules 10 and the second protection modules 20 are arranged alternately, and the adjacent first protection module 10 and the second protection module 20 are arranged according to the arrangement of the breathable structure 100 as described in Embodiment 1.

Embodiment 3

Figure 4:
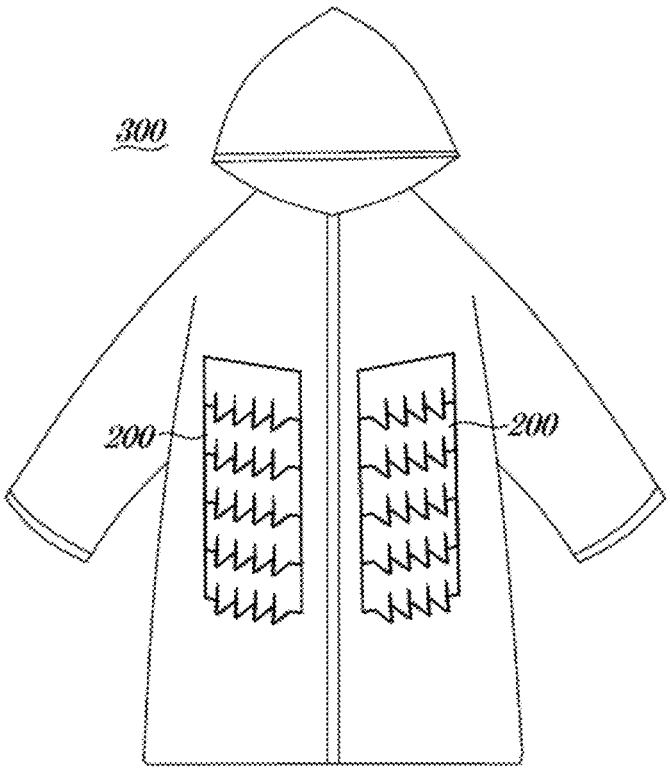
FIG. 4 is a perspective view of the garment according to Embodiment 3 of the present disclosure.

As shown in FIG. 4, this embodiment provides a garment 300 made of the above-mentioned breathable fabric, and the garment 300 may be a raincoat or a protective suit. The garment 300 of this embodiment may be entirely or partially made of the breathable fabric 200 as described in Embodiment 2.

When the garment 300 of this embodiment is partially made of the breathable fabric 200 as described in Embodiment 2, an opening to which the breathable fabric 200 is connected may be reserved on a front and/or back and/or arms and/or trousers and/or a hat, etc. of the garment 300, and then the breathable fabric 200 may be detachably connected to the opening of the corresponding garment.

In addition, in order to facilitate the breathable fabric of this embodiment to be detachably connected to the opening of the corresponding garment, correspondingly, an edge 201 of the breathable fabric is further provided with zippers, velcro tapes, adhesive surfaces, buttons or magnets for detachable connection. Furthermore, while ensuring the protective effect of the garment 300, the functional conversion between protection and breathability can be realized.

To sum up, a modularly arranged protection unit is adopted for the breathable structure of the present disclosure, which can be more conveniently combined and applied to corresponding garments. In the breathable structure of the present disclosure, the first protection units are configured to fit with the second protection units to form relatively narrow and long breathable channels that are closely arranged, so that the breathable structure has both good protection performance and good breathability.

It will be apparent to those skilled in the art that the present disclosure is not limited to the details of the exemplary embodiments described above, and may be embodied in other specific forms without departing from the spirit or essential characteristics of the present disclosure. Therefore, no matter from which point of view, the embodiments should be regarded as exemplary and not restrictive, and the scope of the present disclosure is defined by the appended claims rather than by the above description. It is therefore intended to include in the present disclosure all the changes which come within the meaning and range of equivalent of the claims. Any reference numerals in the claims shall not be construed as limiting the claims involved.

In addition, it should be understood that although the specification is described according to embodiments, not each embodiment contains only one independent technical solution. This description of the specification is just for clarity. Those skilled in the art should take the specification as a whole, and the technical solutions in the embodiments can also be properly combined to form other embodiments that those skilled in the art can understand.

What is claimed is:

1. A breathable structure, comprising a first protection module and a second protection module configured to fit with the same along a length direction;

wherein the first protection module comprises a plurality of first protection units, each of the plurality of the first protection units is arranged along a width direction;

each of the plurality of the first protection units is of an arched sheet structure, and an arching height of the sheet structure decreases along the length direction;

the second protection module comprises a plurality of second protection units corresponding one-to-one to the first protection units, each of the plurality of second protection units is arranged along a width direction;

each of the plurality of the second protection units is of an arched sheet structure, and an arching height of the sheet structure decreases along the length direction; and one end of the second protection unit extends below the first protection unit along the length direction so as to establish a fit between the first protection module and the second protection module, and a breathable channel is formed between the first protection unit and the second protection unit.

2. The breathable structure according to claim 1, wherein the first protection module and the second protection module respectively comprise a plurality of protection units, the protection units are arranged along the width direction.

3. The breathable structure according to claim 1, wherein the first protection unit and the second protection unit are of a sheet structure with an arched shape selected from the group consisting of a pointed top, a dome or a square top.

4. The breathable structure according to claim 1, wherein the first protection unit is aligned with the second protection unit, and in this way, one end of the second protection unit extends directly below the corresponding first protection unit along the length direction.

5. The breathable structure according to claim 1, wherein the first protection unit and the second protection unit are arranged in a staggered manner, such that one end of the second protection unit extends obliquely below the first protection unit along the length direction, and the first protection unit overlaps on an arch surface of the second protection unit.

6. The breathable structure according to claim 1, wherein at least one fifth of the second protection unit extends below the first protection unit.

7. The breathable structure according to claim 1, wherein the first protection module and the second protection module respectively comprise a plurality of protection units, the first protection module and the second protection module are integrally formed, or each of the first protection units is connected to a first substrate and each of the second protection units is connected to a second substrate.

8. A breathable fabric, comprising multiple first protection modules and multiple second protection modules;

wherein the first protection modules and the second protection modules are adjacently arranged to form the breathable structure defined in claim 1.

9. A garment, being entirely or partially made of the breathable fabric according to claim 8.

10. The garment according to claim 9, wherein the garment is partially made of the breathable fabric, the breathable fabric is detachably attached to a front and/or back and/or sleeves and/or trousers and/or a hat of the garment.

11. The garment according to claim 9, wherein the garment is a raincoat or a protective suit.

* * * * *